US010976055B2

(12) United States Patent
Mao et al.

(10) Patent No.: US 10,976,055 B2
(45) Date of Patent: Apr. 13, 2021

(54) ELECTROMAGNETIC HEATING DEVICE

(71) Applicants: FOSHAN SHUNDE MIDEA ELECTRICAL HEATING APPLIANCES MANUFACTURING CO., LTD., Foshan (CN); MIDEA GROUP CO., LTD., Foshan (CN)

(72) Inventors: Hongjian Mao, Foshan (CN); Zhicai Liu, Foshan (CN); Zhifeng Wang, Foshan (CN); Yifan Chen, Foshan (CN); Jiangping Feng, Foshan (CN); Zhihai Ma, Foshan (CN); Dali Ou, Foshan (CN)

(73) Assignees: FOSHAN SHUNDE MIDEA ELECTRICAL HEATING APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 376 days.

(21) Appl. No.: 15/910,935

(22) Filed: Mar. 2, 2018

(65) Prior Publication Data

US 2018/0245794 A1 Aug. 30, 2018

Related U.S. Application Data

(63) Continuation of application No. PCT/CN2015/099259, filed on Dec. 28, 2015.

(30) Foreign Application Priority Data

Nov. 27, 2015 (CN) ..... 201510893598.6
Nov. 27, 2015 (CN) ..... 201510893639.1
(Continued)

(51) Int. Cl.
*F24C 7/06* (2006.01)
*H05B 6/06* (2006.01)
(Continued)

(52) U.S. Cl.
CPC ..... *F24C 7/06* (2013.01); *F24C 7/04* (2013.01); *F24C 7/087* (2013.01); *H05B 3/0076* (2013.01);
(Continued)

(58) Field of Classification Search
CPC ... F24C 7/06; F24C 7/04; F24C 7/087; H05B 6/062; H05B 6/129; H05B 6/36; H05B 6/06; H05B 3/0076; H05B 2203/032
See application file for complete search history.

(56) References Cited

U.S. PATENT DOCUMENTS

2004/0094533 A1 5/2004 Gerhardinger

FOREIGN PATENT DOCUMENTS

CN 2712038 Y 7/2005
CN 1809229 * 7/2006
(Continued)

OTHER PUBLICATIONS

Foshan Shunde Midea Electrical Heating Appliances; Midea Group Co. Ltd., International Search Report and Written-Opinion, PCT/CN2015/099259, dated Aug. 24, 2016, 15 pgs.

*Primary Examiner* — Shawntina T Fuqua
(74) *Attorney, Agent, or Firm* — Morgan, Lewis & Bockius LLP

(57) ABSTRACT

The present disclosure provides an electromagnetic heating device, comprising: an electromagnetic heating unit, an infrared heating unit and a MCU. The MCU is coupled with the electromagnetic heating unit and the infrared heating unit, so as to control the electromagnetic heating unit and the infrared heating unit to heat individually or simultaneously. The electromagnetic heating device of the present disclosure, since it comprises an electro electromagnetic heating unit and an infrared heating unit, the heating of the heating appliances of different materials can be performed, the
(Continued)

application thereof is wide and unrestricted. In addition, since the infrared heating unit is comprised, the maximum heating power thereof is not limited by that of the coil disk.

12 Claims, 8 Drawing Sheets

(30) Foreign Application Priority Data

Nov. 27, 2015 (CN) ..... 201510893659.9
Nov. 27, 2015 (CN) ..... 201521007266.5

(51) Int. Cl.

| | |
|---|---|
| ***F24C 7/04*** | (2021.01) |
| ***F24C 7/08*** | (2006.01) |
| ***H05B 3/00*** | (2006.01) |
| ***H05B 6/12*** | (2006.01) |
| ***H05B 6/36*** | (2006.01) |

(52) U.S. Cl.
CPC ..... *H05B 6/06* (2013.01); *H05B 6/062* (2013.01); *H05B 6/129* (2013.01); *H05B 6/36* (2013.01); *H05B 2203/032* (2013.01)

(56) References Cited

FOREIGN PATENT DOCUMENTS

| | | | | |
|---|---|---|---|---|
| CN | 1809229 | A | | 7/2006 |
| CN | 201297678 | Y | | 8/2009 |
| CN | 201323669 | Y | | 10/2009 |
| CN | 201335433 | Y | | 10/2009 |
| CN | 102156416 | A | | 8/2011 |
| CN | 202077214 | U | | 12/2011 |
| CN | 202206580 | U | | 4/2012 |
| CN | 102613880 | A | | 8/2012 |
| CN | 204483887 | U | | 7/2015 |
| CN | 204483889 | U | | 7/2015 |
| CN | 204539512 | U | | 8/2015 |
| CN | 204634072 | U | | 9/2015 |
| CN | 205162733 | | * | 4/2016 |
| CN | 205162733 | U | | 4/2016 |
| FR | 2744200 | A1 | | 8/1997 |
| JP | H06349570 | A | | 12/1994 |
| JP | 2009004141 | A | | 1/2009 |

* cited by examiner

ELECTROMAGNETIC HEATING DEVICE

PRIORITY CLAIM AND RELATED APPLICATION

This application is a continuation application of PCT/CN2015/099259, entitled "ELECTROMAGNETIC HEATING DEVICE" filed on Dec. 28, 2015, which claims priority to (i) Chinese Patent Application No. 201510893598.6, filed with the State Intellectual Property Office of the People's Republic of China on Nov. 27, 2015, (ii) Chinese Patent Application No. 201510893659.9, filed with the State Intellectual Property Office of the People's Republic of China on Nov. 27, 2015, (iii) Chinese Patent Application No. 201510893639.1, filed with the State Intellectual Property Office of the People's Republic of China on Nov. 27, 2015, and (iv) Chinese Patent Application No. 201521007266.5, filed with the State Intellectual Property Office of the People's Republic of China on Nov. 27, 2015, all of which are incorporated herein by reference in their entirety.

TECHNICAL FIELD

The present disclosure relates to electromagnetic heating technology, particularly to an electromagnetic heating device.

BACKGROUND

The existing electromagnetic heating devices such as electromagnetic oven which usually has only coil disks, is able to merely heat ferromagnetic cooking appliances while unable to heat un-ferromagnetic cooking appliances, the variety of the cooking appliances that is used by the electromagnetic oven is limited. In addition, for ferromagnetic cooking appliances, the maximum heating power thereof is also restricted by that of the coil disks.

SUMMARY

The technical problem to be solved by the present disclosure is: providing an electromagnetic heating device comprising not only an electromagnetic heating unit, but also an infrared heating unit, so that the restriction of applying the electromagnetic oven with single electromagnetic heating can be avoided.

An electromagnetic heating device comprises: an electromagnetic heating unit, an infrared heating unit and a MCU, and the MCU is coupled with the electromagnetic heating unit and the infrared heating unit so as to control the electromagnetic heating unit and the infrared heating unit to heat individually or simultaneously.

In some embodiments, the MCU comprises a power-detecting module and a power distribution module; the power-detecting module detects a power value entered by the user and sends it to the power distribution module; the power distribution module distributes power to the electromagnetic heating unit and/or the infrared heating unit based on the received power value entered by the user.

In some embodiments, the power distribution module switches to enable the infrared heating unit to heat individually when the power-detecting module detects that the power entered by the user is lower than a first preset power value; the power distribution module switches to enable the electromagnetic heating unit and/or the infrared heating unit to heat when the power-detecting module detects that the power entered by the user is higher than the first preset power value.

In some embodiments, the first preset power value ranges from 800 W to 1100 W.

In some embodiments, the power distribution module switches to enable the electromagnetic heating unit to heat individually when the power-detecting module detects that the power entered by the user is higher than or equal to the first preset power value and lower than a second preset power value, the power distribution module switches to enable the electromagnetic heating unit and the infrared heating unit to heat simultaneously when the power-detecting module detects that the power entered by the user is higher than or equal to the second preset power value, the second preset power value is higher than the first preset power value.

In some embodiments, the second preset power value ranges from 1500 W to 1700 W.

In some embodiments, the power distribution module switches to enable the electromagnetic heating unit and the infrared heating unit to heat simultaneously when the power-detecting module detects that the power entered by the user is higher than the second preset power value; the power distribution module switches to enable the electromagnetic heating unit to heat when the power-detecting module detects that the power entered by the user is lower than the second preset power value.

In some embodiments, the second preset power value is 1500 W-1700 W.

In some embodiments, a heating power value distributed by the power distribution module to the electromagnetic heating unit is lower than or equal to the second preset power value and higher than the first preset power value when the power entered by the user is higher than the second preset power value, a heating power value distributed by the power distribution module to the infrared heating unit is the difference value between the power value entered by the user and the power value distributed to the electromagnetic heating unit.

In some embodiments, the power distribution module switches to enable the electromagnetic heating unit and the infrared heating unit to heat simultaneously when the power-detecting module detects that the power entered by the user is higher than a third preset power value; the power distribution module switches to enable at least one of the electromagnetic heating unit and the infrared heating unit to heat when the power-detecting module detects that the power entered by the user is lower than the third preset power value; wherein the third preset power value is 0.9-1 times of a rated heating power value of the electromagnetic heating unit.

In some embodiments, the third preset power value ranges from 2000 W to 2200 W.

In some embodiments, the MCU further comprises a material-detecting module, when the material-detecting module detects a ferromagnetic cooking appliance, the power distribution module switches to enable the electromagnetic heating unit and/or the infrared heating unit to heat the cooking appliance; when the material-detecting module detects an un-ferromagnetic cooking appliance, the power distribution module switches to enable the infrared heating unit to heat the cooking appliance individually.

In some embodiments, the MCU comprises a heating switch reminder module which reminds the user to select a corresponding heating unit to heat based on the cooking appliance material detected by the material-detecting module.

In some embodiments, the electromagnetic heating unit comprises: a resonance circuit comprising a switch element, a resonance capacitor and a resonance inductor, one of the common connecting ends of the resonance capacitor and the resonance inductor is connected to the rectified mains supply, the other common connecting end is coupled with a collector of the switch element; an electromagnetic drive circuit, one end of the electromagnetic drive circuit is coupled with MCU, the other end is coupled with a base electrode of the switch element; a resonance synchronization detecting circuit, one end is coupled with the collector of the switch element so as to detect a voltage of the collector of the switch element, the other end is coupled with the MCU; the material-detecting module determines the material of the cooking appliance by detecting a time interval of the adjacent reverse voltage outputted by the resonance synchronization detecting circuit after the MCU sending a pan-detecting pulse to the electromagnetic drive circuit.

In some embodiments, the electromagnetic heating unit comprises an ultrasonic emission circuit and an ultrasonic detection circuit, the ultrasonic emission circuit emits a detecting ultrasonic, and the material-detecting module determines the material of the cooking appliance based on the frequency and amplitude range of a detected ultrasonic reflection signal.

In some embodiments, the MCU further comprises a pan-detecting module; when the pan-detecting module detects that the cooking appliance is not presented, the heating power distributed to the infrared heating unit and the electromagnetic heating unit by the power distribution module are zero; when the pan-detecting module detects the presence of the cooking appliance, the power distribution module distributes the heating power to at least one of the infrared heating unit and the electromagnetic heating unit.

In some embodiments, the electromagnetic heating unit comprises: a resonance circuit comprising a switch element, a resonance capacitor and a resonance inductor, the resonance capacitor is coupled with the resonance inductor in parallel, one of the common connecting ends of the resonance capacitor and the resonance inductor is connected to the rectified mains supply, the other common connecting end is coupled with a collector of the switch element; an electromagnetic drive circuit, one end of the electromagnetic drive circuit is coupled with an electromagnetic power adjusting module in the MCU, the other end is coupled with the base electrode of the switch element; a resonance synchronization detecting circuit, one end is coupled with the collector of the switch element so as to detect a voltage of the collector of the switch element, the other end is coupled with the MCU; the pan-detecting module determines the presence of the cooking appliance by judging whether the times of the resonance synchronization detecting circuit outputting the voltage reverses is lower than a preset number after the MCU sending a pan-detecting pulse to the electromagnetic drive circuit.

In some embodiments, the electromagnetic heating unit comprises an ultrasonic emission circuit and an ultrasonic detection circuit, the ultrasonic emission circuit emits a detecting ultrasonic, and the pan-detecting module determines the presence of the cooking appliance based on whether the ultrasonic detection circuit detects an ultrasonic reflection signal.

In some embodiments, the electromagnetic heating unit comprises a resonance circuit and an electromagnetic drive circuit, one end of the electromagnetic drive circuit is coupled with the resonance circuit, the other end is coupled with the electromagnetic power adjusting module in the MCU, the electromagnetic power adjusting module inputs a PWM signal of a first preset duty ratio to the electromagnetic drive circuit based on the distributed heating power value.

In some embodiments, the infrared heating unit comprises an infrared heating circuit and an infrared drive circuit; the infrared heating circuit comprises an infrared heating film coupled between the null line and the live line of the mains supply, one end of the infrared drive circuit is coupled between the infrared heating film and the mains supply, the other end of the infrared drive circuit is coupled with an infrared power adjusting module in the MCU, the infrared power adjusting module inputs a PWM signal of a second preset duty ratio to the infrared drive circuit based on the distributed heating power value.

In some embodiments, the electromagnetic heating unit comprises a zero-crossing detecting circuit, one end of the zero-crossing detecting circuit is connected to the rectified mains supply so as to detect a zero-crossing signal of the mains supply, the other end is coupled with the MCU; the infrared power adjusting module inputs a PWM signal of the second preset duty ratio to the infrared drive circuit at a preset time based on the zero-crossing signal detected by the zero-crossing detecting circuit.

In some embodiments, the infrared drive circuit comprises energy-storage capacitors, a first switch, an inductor and a first diode, the energy-storage capacitor are coupled in series between the infrared heating film and the mains supply, the end coupled with the mains supply of the energy-storage capacitors is coupled with a source electrode of the first switch through the inductor, the end coupled with the infrared heating film of the energy-storage capacitors is coupled with a source electrode of the first switch through the first diode, a drain electrode of the first switch is coupled with the mains supply, a grid electrode of the first switch is coupled with the infrared power adjusting module of the MCU.

In some embodiments, the infrared drive circuit further comprises a second switch and a second diode, a common coupling end of the inductor and the energy-storage capacitors is coupled with a drain electrode of the second switch, the mains supply is coupled with a source electrode of the second switch, the second diode is coupled between the drain electrode of the second switch and the energy-storage capacitors.

In some embodiments, the infrared drive circuit comprises a switch subunit and an isolation subunit, the switch subunit is coupled between the infrared heating film and the mains supply, the isolation subunit is coupled between the switch subunit and the infrared power adjusting module of the MCU.

In some embodiments, the switch subunit is a TRIAC, the isolation subunit is an isolation optocoupler.

An electromagnetic heating device comprises:

a board provided under a cooking appliance for supporting the cooking appliance;

a coil disk provided under the board for electromagnetically heating the cooking appliance;

an infrared heating assembly for infraredly heating the cooking appliance; and an electric control panel under the board and electrically connected with the coil disk and the infrared heating assembly for controlling the heating of the coil disk and the infrared heating assembly.

In some embodiments, the infrared heating assembly is mounted on the board.

In some embodiments, the infrared heating assembly is mounted on the surface of the side near the cooking appliance of the board, the infrared heating assembly comprises an infrared heating film and a heat reflecting film, the infrared heating film is attached to the board, the heat reflecting film is attached to the infrared heating film.

In some embodiments, the infrared heating assembly further comprises a heat insulating film attached to the heat reflecting film.

In some embodiments, a thermal temperature sensor for detecting a bottom temperature of the cooking appliance is provided on the coil disk, a through-hole for the thermal temperature sensor to pass through is provided on the infrared heating film, such that the thermal temperature sensor directly contacts with the board.

In some embodiments, the distance between the board and the coil disk is 8 mm-11 mm.

In some embodiments, the infrared heating assembly is mounted on the outer surface of the appliance.

In some embodiments, the infrared heating assembly is mounted on the outer surface of the side wall of the appliance.

In some embodiments, the infrared heating assembly comprises an infrared heating film and a first electric insulating film, the infrared heating film is attached to the outer surface of the cooking appliance, the first electric insulating film is attached to the infrared heating film.

In some embodiments, the infrared heating assembly comprises an infrared heating film, a first electric insulating film and a second electric insulating film, the second electric insulating film is attached to the outer surface of the cooking appliance, the infrared heating film is attached to the second electric insulating film, the first electric insulating film is attached to the infrared heating film.

In some embodiments, the infrared heating assembly comprises a terminal connecting the infrared heating film, a power port into which the terminal inserts is provided on the board.

The electromagnetic heating device provided by the present disclosure, since it comprises an electro electromagnetic heating unit and an infrared heating unit, the heating of the heating appliances of different materials can be performed, the application thereof is wide and unrestricted; and since the infrared heating unit is comprised, the maximum heating power thereof is not limited by that of the coil disk.

DESCRIPTION OF THE EMBODIMENTS

Figure 1:
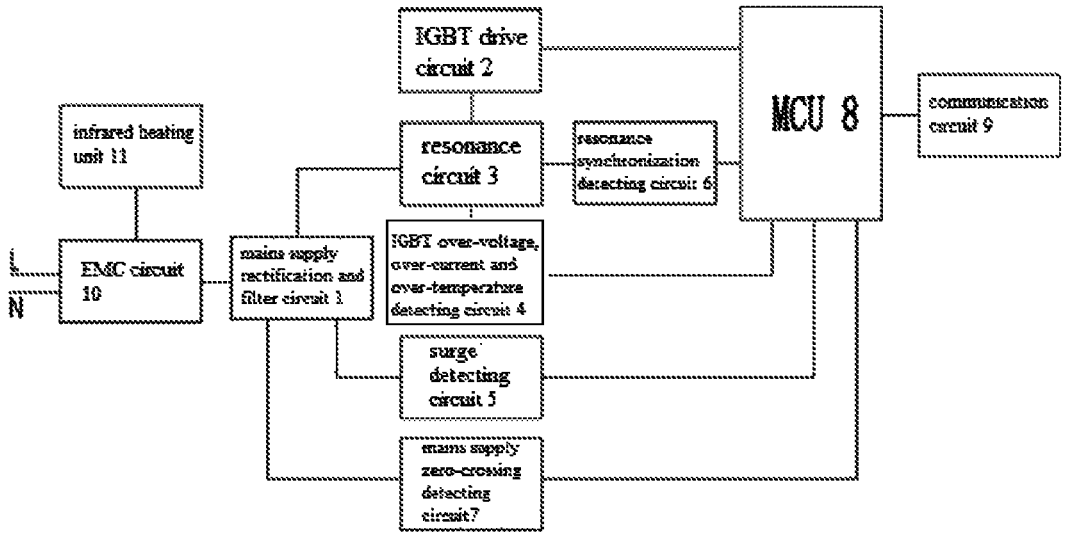
FIG. 1 is a schematic diagram of the circuit module of the electromagnetic heating device of embodiment 1.

The specific implementing methods of the present disclosure are described in more detail hereinafter with reference to the accompanying drawings and embodiments. The following embodiments are intended to illustrate the present disclosure, but not to limit the scope thereof.

In the description of the present disclosure, it should be noted that the orientation or position relations indicated by terms "left", "right" etc. are the orientation or position relations based on the illustration of the accompanying drawings, which are only for the sake of describing the present disclosure and simplifying the description, but do not indicate or imply that the devices or elements referred to must have specific orientations, or to be constructed and operated thereon. Therefore, the orientation or position relations cannot be construed as limiting the present disclosure. In addition, terms "first", "second" and "third" are for descriptive purpose only, but cannot be construed as indicating or implying the relative importance.

Embodiment 1

The present embodiment 1 is mainly used to describe the circuits of the electromagnetic heating device, specifically, the electromagnetic heating device provided by the present embodiment 1 comprises an electromagnetic heating unit, an infrared heating unit and an MCU, wherein the MCU is connected with the electromagnetic heating unit and the infrared heating unit, so as to control the electromagnetic heating unit and the infrared heating unit to heat individually or simultaneously.

Since an infrared heating unit is provided, the electromagnetic heating unit of the present embodiment 1 is able to heat the un-ferromagnetic cooking appliances. In addition, the infrared heating unit can also heat the ferromagnetic cooking appliances in conjunction with the electromagnetic heating unit, so as to increase the heating speed and the maximum heating power for the ferromagnetic cooking apparatus. Generally, the users could manually distinguish the ferromagnetic and un-ferromagnetic appliances based on the material label or the material specification attached to the cooking appliances.

Further, the MCU of the electromagnetic heating unit provided by the present embodiment 1 comprises a pan-detecting module and a power distribution module. Wherein, when the pan-detecting module detects that the cooking appliance is not presented, the heating power distributed to the infrared heating unit and the electromagnetic heating unit by the power distribution module are zero, such that none of the infrared heating unit and the electromagnetic heating unit is heating. When the pan-detecting module detects the presence of the cooking appliance, the power distribution module distributes the heating power to at least one of the infrared heating unit and the electromagnetic heating unit. For example, when the pan-detecting module detects the presence of the ferromagnetic pan, the power distribution module may only provide a heating power to the infrared heating unit, only provide a heating power to the electromagnetic heating unit, or provide heating power to the infrared heating unit and the electromagnetic heating unit at the same time. When the pan-detecting module detects the presence of the un-ferromagnetic pan, the power distribution module only provides a heating power to the infrared heating unit.

In addition, the MCU of the electromagnetic heating unit provided by the present embodiment 1 may further comprise a material-detecting module and a power distribution module, when the material-detecting module detects a ferromagnetic cooking appliance, the power distribution module switches to enable the electromagnetic heating unit and/or the infrared heating unit to heat the cooking appliance; when the material-detecting module detects an un-ferromagnetic cooking appliance, the power distribution module switches to enable only the infrared heating unit to heat the cooking appliance.

Specifically, the MCU also comprises a heating switch reminder module which reminds the user to select a corresponding heating unit to heat, based on the cooking appliance material detected by the material-detecting module. For example, when the material-detecting module detects the presence of the ferromagnetic pans, the heating switch reminder module reminds the users to select one from the three heating ways of electromagnetic heating, infrared heating and the combinative heating of the electromagnetic heating unit and the infrared heating unit.

It can be understood by the person skilled in the art that the power distribution module connected with the pan-detecting module and the power distribution module connected with the material-detecting module could be the same power distribution module.

The electromagnetic heating unit of the present embodiment 1 further comprises a power-detecting module which detects the power value entered by the user and sends it to the power distribution module. The power distribution module distributes power to the electromagnetic heating unit and/or the infrared heating unit based on the received power value entered by the user.

On the basis above, the present embodiment 1 also provides a distribution method of the heating power between the electromagnetic heating unit and the infrared heating unit. From the perspective of implementing a low-power continuous heating of the electromagnetic heating device, the technical solution provided by the embodiment is: the power distribution module enabling only the heating of the infrared heating unit when the power-detecting module detects that the power entered by the user is lower than a first preset power value; the power distribution module enabling the heating of the electromagnetic heating unit and/or the infrared heating unit when the power-detecting module detects that the power entered by the user is higher than the first preset power value. Generally, if the electromagnetic heating unit heats continuously with a power lower than the first preset power value, there will be a serious hard switching on the IGBT of the electromagnetic oven, resulting in large loss, high temperature rise and shortened life of the IGBT. In order to solve the problem, the current electromagnetic heating devices adopt a power-adjusting heating method, i.e. to heat with large power for some time, then stop heating for some time, then heat for some time and stop later for some time. For example, in order to implement the heating with power of 400 W, the electromagnetic oven firstly heats with power of 800 W for 1 second, then stops heating for 1 second. This intermittent heating method causes big temperature changes of the pans and the food therein, it is not applicable and less effective in the cases that require a continuous low-temperature heating control, such as cooking soups etc. While the heating of the infrared heating unit is a resistive heating, which is different from the heating of the electromagnetic heating unit, therefore it is capable of heating continuously with a power lower than the first preset power value. The first preset power value is equivalent to the critical value with which the electromagnetic heating unit could implement continuous heating alone based on the power value entered by the user and the IGBT hard switching will not occur. The first preset power value in the present embodiment 1 is set to range from 800 W-1000 W, a specific first preset power value provided by the present embodiment is 1000 W. Certainly, the range of the first preset power value may also be adjusted accordingly based on actual needs.

When the power value entered by the user is higher than the first preset power value, the present embodiment 1 further optimizes the heating power distribution for the infrared heating unit and the electromagnetic heating unit. Specifically, a second preset power value greater than the first preset power value is set by the present embodiment 1, when the power-detecting module detects that the power entered by the user is higher than the first preset power value but lower than the second preset power value, the power distribution module switches to enable only the electromagnetic heating unit to heat, accordingly, the heating power value distributed to the infrared heating unit by the power distribution module in the MCU is zero. When the power-detecting module detects that the power entered by the user is higher than the second preset power value, the power distribution module switches to enable the electromagnetic heating unit and the infrared heating unit to heat at the same time, accordingly, the power distribution module in the MCU distributes heating power with certain values to the infrared heating unit and the electromagnetic heating unit at the same time. The electromagnetic heating unit directly heats the cooking appliances which are heating elements, while the infrared heating unit transmits the heat of the infrared heating film to the cooking appliances, that is, the infrared heating film is the heating element and the cooking appliances are only thermal mediums, therefore the heating efficiency of the electromagnetic heating unit is higher than that of the infrared heating unit. When the power entered by the user is higher than the first preset power value and lower than the second preset power value, although the infrared heating unit may be selected to heat or the infrared heating unit and the electromagnetic heating unit may be selected to heat in combination, it is preferred to enable only the electromagnetic heating unit to heat, from the perspective of improving the heating efficiency of the electromagnetic heating device. But when the power entered by the user is higher than a certain value, i.e. higher than the second preset power value, such as 1800 W, if still only the electromagnetic heating unit is started to heat, the electromagnetic heating unit will not only produce big noises, but the electronic elements thereof such as the IGBT will also be more vulnerable to damages. If only considering of reducing the noise of the electromagnetic oven and improving the lifetime of the electronic elements thereof, enabling only the infrared heating unit to heat may be selected. However, comprehensively considering of improving the heating efficiency, reducing the noise of the electromagnetic oven and improving the lifetime of the electronic elements thereof, the power distribution module switches to enable the infrared heating unit and electromagnetic heating unit to heat at the same time when the power entered by the user is higher than the second preset power value. The second preset power value is set to range from 1500 W-1700 W by the present embodiment 1, and certainly it may also be adjusted accordingly based on actual needs.

For the case where the power entered by the user is higher than the second preset power value, the power distribution module of the MCU distributes corresponding heating power values to the electromagnetic heating unit and the infrared heating unit based on a preset algorithm. A preset algorithm provided by the present embodiment is: the heating power value distributed to the electromagnetic heating unit by the power distribution module of the MCU is lower than or equal to the second preset power value and higher than the first preset power value, the heating power distributed to the infrared heating unit by the power distribution module of the MCU is the difference value between the power value entered by the user and the power value distributed to the electromagnetic heating unit. Certainly, the power distribution module of the MCU may also distribute power to the infrared heating unit and the electromagnetic heating unit based on other present algorithms. The table below is a specific algorithm for the power distribution module of the MCU in the present embodiment 1 distributing heating power to the infrared heating unit and the electromagnetic heating unit based on the heating power entered by the user. In the table below, the rated heating power of the electromagnetic oven is 2100 W, it can be seen from the table that the electromagnetic oven provided by the present embodiment 1 could heat continuously between 100 W to 2100 W, such that the electromagnetic oven is able to not only satisfy the requirement of continuous heating with low power (such as the various application scenarios like cooking soups etc.), but also satisfy the requirement of reducing noises and improving heating efficiency under high power heating.

TABLE 1

| Power entered by the user (W) | Electromagnetic heating power (W) | Infrared heating power (W) |
|---|---|---|
| 2100 W | 1600 | 500 |
| 2000 W | 1600 | 400 |
| 1900 W | 1600 | 300 |
| 1800 W | 1600 | 200 |
| 1700 W | 1600 | 100 |
| 1600 W | 1600 | 0 |
| 1500 W | 1500 | 0 |
| 1400 W | 1400 | 0 |
| 1300 W | 1300 | 0 |
| 1200 W | 1200 | 0 |
| 1100 W | 1100 | 0 |
| 1000 W | 1000 | 0 |
| 900 W | 0 | 900 |
| 800 W | 0 | 800 |
| 700 | 0 | 700 |
| 600 | 0 | 600 |
| 500 | 0 | 500 |
| 400 | 0 | 400 |
| 300 | 0 | 300 |
| 200 | 0 | 200 |
| 100 | 0 | 100 |

If considering from only reducing the noise of the electromagnetic oven and improving the lifetime of the electronic components of the electromagnetic oven, the technical solution provided by the present embodiment is: the power distribution module switching to enable the electromagnetic heating unit and the infrared heating unit to heat simultaneously when the power-detecting module detects that the power entered by the user is higher than the second preset power value; the power distribution module switching to enable the electromagnetic heating unit to heat when the power-detecting module detects that the power entered by the user is lower than the second preset power value. That is, unlike the technical solutions based on achieving the continuous heating with low power of the electromagnetic oven, the electromagnetic heating unit rather than the infrared heating unit is selected to heat when the power entered by the user is lower than the first preset power value.

If considering from improving the total heating power of the electromagnetic heating device, the technical solution provided by the present embodiment is: the power distribution module switching to enable the electromagnetic heating unit and the infrared heating unit to heat simultaneously when the power-detecting module detects that the power entered by the user is higher than a third preset power value; the power distribution module switching to enable at least one of the electromagnetic heating unit and the infrared heating unit to heat when the power-detecting module detects that the power entered by the user is lower than the third preset power value; wherein the third preset power value is 0.9-1 times of the rated heating power value of the electromagnetic heating unit.

Since the electromagnetic heating unit is easy to be damaged by heating with the rated power for a long time, the preferred technical solution of the present embodiment is to set the third preset power value to be slightly lower than the rated heating power value of the electromagnetic heating unit, such that the power distribution module enables the electromagnetic heating unit and the infrared heating unit to heat simultaneously before the electromagnetic heating unit has not been heating with full power. For example, when the rated heating power (i.e. the maximum heating power) of the electromagnetic heating unit is 2200 W, the power distribution module enables the electromagnetic heating unit and the infrared heating unit to heat at the same time if the power-detecting module detects that the power entered by the user is higher than 2000 W. Certainly, the third preset power value may be also adjusted based on the factors such as the rated power of different electromagnetic heating devices. For example, when the rated heating power of the electromagnetic heating unit is 2100 W, the preferred range of the third heating power value is 1900 W to 2100 W.

With this technical solution, if the maximum rated heating power that can be provided by the infrared heating unit is 1000 W, the maximum heating power could be increased to 3000 W-3200 W by this combined heating of the infrared heating unit and the electromagnetic heating unit. It should be noted that if the power-detecting module detects that the power entered by the user is lower than the third preset power value, only the electromagnetic heating unit may be selected to heat, but the heating selections may not be limited as follows: the power distribution module selecting to enable the electromagnetic heating unit and the infrared heating unit to heat simultaneously when the power entered by the user is higher than the second preset power value; the power distribution module selecting to enable the infrared heating unit to heat when the power entered by the user is lower than the first preset power value. For example, when the third preset power value is set to range from 2000 W-2200 W, the electromagnetic heating unit may be used to heat within the range lower than the third preset power value, also, the infrared heating unit may be used to heat within the range lower than the first preset power value (0 to 800-1100), and the electromagnetic heating unit may be used to heat within the range from the first preset power value to the second preset power value (such as 800-1100 to 1500-1700), the electromagnetic heating unit and the infrared heating unit may be used to heat simultaneously within the range from the second preset power value to the third preset power value (such as 1500-1700 to 2000-2200).

It should be noted that a discontinuous heating will occur when the electromagnetic heating unit and the infrared heating unit switch to heat. In some embodiments, in the present embodiment 1, during the heating switch of the electromagnetic heating unit and the infrared heating unit, the previous heating unit continues to heat for a delayed time after the later heating unit has started to heat. For example, when it is switched from heating with only the infrared heating unit to heating with only the electromagnetic heating unit, there is a short period of time (about 5 seconds) when the infrared heating unit and the electromagnetic heating unit are in a heating-together state.

The electromagnetic heating device provided by the present embodiment 1 may comprise both the pan-detecting module and the material-detecting module above, or comprise at least one of the pan-detecting module and the material-detecting module. Hereinafter, the present embodiment 1 provides a pan and material detecting method based on the electromagnetic heating unit.

Hereinafter the main circuits of the electromagnetic heating unit are illustrated with reference to FIG. 1, FIG. 4 and FIG. 5. The electromagnetic heating unit usually comprises at least a resonance circuit and an electromagnetic drive circuit, one end of the electromagnetic drive circuit is coupled with the resonance circuit, the other end is coupled with the electromagnetic power adjusting module of the MCU. The electromagnetic power adjusting module inputs a PWM signal of a first preset duty ratio to the electromagnetic drive circuit based on the distributed heating power value.

Wherein the resonance circuit comprises a switch element, a resonance capacitor and a resonance inductor, the resonance capacitor is coupled with the resonance inductor in parallel, one of the common connecting ends of the resonance capacitor and the resonance inductor is connected to the rectified mains supply, the other common connecting end is coupled with a collector of the switch element, wherein the switch element is usually a IGBT.

The electromagnetic heating unit further comprises a resonance synchronization detecting circuit. One end of the resonance synchronization detecting circuit is coupled with the two common connecting ends of the resonance capacitor and inductor respectively, that is, there is a branch in the end couples with the collector of the IGBT so as to detect the voltage thereof. The other end of the resonance synchronization detecting circuit is coupled with the MCU, when the resonance synchronization detecting circuit detects that the voltage of the IGBT collector is the lowest (usually zero), the electromagnetic power adjusting module of the MCU outputs the PWM signal of the first preset duty ratio to the electromagnetic drive circuit.

The electromagnetic heating unit may further comprise a zero-crossing detecting circuit, one end of the zero-crossing detecting circuit is connected to the rectified mains supply so as to detect the zero-crossing signal of the mains supply, the other end is coupled with the MCU, the electromagnetic power adjusting module inputs a reinitialized PWM signal of the first preset duty ratio to the electromagnetic drive circuit after receives the zero-crossing signal.

The electromagnetic heating unit may further comprise a surge detecting circuit, an over-temperature detecting circuit, an over-voltage detecting circuit and an over-current detecting circuit. The surge detecting circuit detects the voltage signal of the mains supply, when the mains supply suddenly happens to have a high forward voltage or negative voltage; the surge detecting circuit sends an IGBT shutdown signal to the MCU. The over-temperature detecting circuit sends the IGBT shutdown signal to the MCU when the temperature of the IGBT which is the switch element reaches to a certain value. The over-voltage detecting circuit sends the IGBT shutdown signal to the MCU when the collector voltage of the IGBT which is the switch element reaches to a certain value. The over-current detecting circuit sends the IGBT shutdown signal to the MCU when the collector current of the IGBT which is the switch element reaches to a certain value.

Obviously, the electromagnetic heating unit may comprise other circuits, which is not limited by the illustrated circuits above. In addition, the electromagnetic heating unit may adopt other circuits that are different from the illustrated circuits above to perform electromagnetic heating.

As for the above-illustrated circuits in the electromagnetic heating unit of the present embodiment 1, the pan-detecting module in the MCU may detect the presence of the cooking appliances in cooperation with the resonance circuit, the electromagnetic drive circuit and the resonance synchronization detecting circuit therein. The material-detecting module in the MCU may also detect the material of the cooking appliances in cooperation with the resonance circuit, the electromagnetic drive circuit and the resonance synchronization detecting circuit therein.

Specifically, a pan-detecting pulse is inputted to the electromagnetic drive circuit through the electromagnetic power adjusting module in the MCU first, the conducting time of the pan-detecting pulse is 6 us-10 us; the transmission interval of the pan-detecting pulse is about 1 S-2 S. The pan-detecting pulse conducts the resonance circuit, if a cooking appliance is carried by the electromagnetic oven, the resonance circuit will consume power faster and the resonance synchronization detecting circuit will output less voltage reverses. If no cooking appliance is carried by the electromagnetic oven, the resonance circuit will consume power slower and the resonance synchronization detecting circuit will output more voltage reverses. The pan-detecting module determines the presence of the cooking appliance by judging whether the times of the resonance synchronization detecting circuit outputting the voltage reverses reaches to a preset number. For example, the preset number is 10, when the times of the resonance synchronization detecting circuit outputting the voltage reverses is bigger than or equal to 10, it is determined that cooking appliance exists, when the times of the resonance synchronization detecting circuit outputting the voltage reverses is smaller than 10, it is determined that there is no cooking appliance.

The material-detecting module determines the material of the cooking appliance by detecting the time interval of the resonance synchronization detecting circuit outputting an adjacent reverse voltage. For example, within a preset time after the electromagnetic power adjusting module in the MCU inputs a pan-detecting pulse to the electromagnetic drive circuit, the voltage outputted by the resonance synchronization detecting circuit reverses for 12 times in total, and when the reverse period is about 35 us, it is determined that the material of the cooking appliance is steel 430, and when the reverse period is about 25 us, it is determined that the material of the cooking appliance is steel 304.

Figure 4:
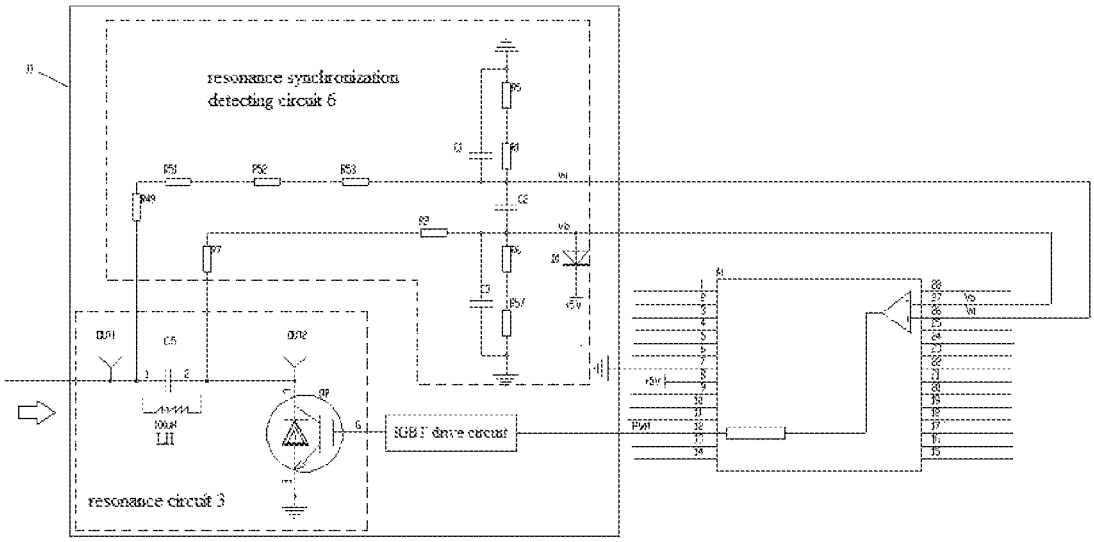
FIG. 4 is a schematic diagram of the connection relation of the MCU between the resonance circuit, resonance synchronization detecting circuit and IGBT drive circuit in the electromagnetic heating unit.

FIG. 4 illustrates the specific compositions of the resonance circuit and the resonance synchronization detecting circuit. The operating principles of detecting the presence of the cooking appliances and detecting the material of the cooking appliance are described hereinafter in combination with the resonance circuit, the electromagnetic drive circuit and the resonance synchronization detecting circuit of the electromagnetic heating unit. The arrow direction in the leftmost of FIG. 4 refers to the input of the rectified mains supply.

Figure 5:
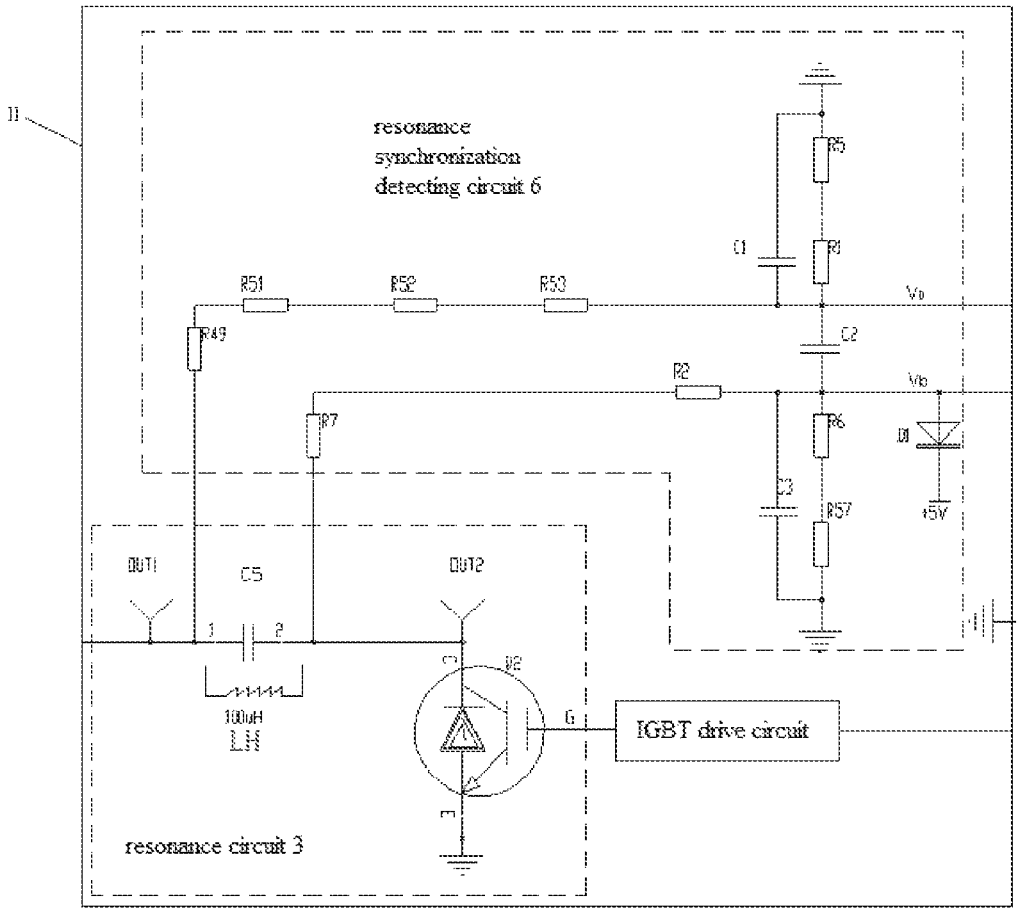
FIG. 5 is a partially enlarged schematic diagram of II of FIG. 4.

Before the electromagnetic oven starts to heating, a pulse with a certain conducting time is outputted, when the electromagnetic drive circuit i.e. the IGBT drive circuit of FIG. 5 is conducted, there are currents flow from left to right on a coil disk LH i.e. the resonance inductor in the resonance circuit. A voltage signal Va which is divided by R49, R51, R52, R53, R1, R5 in the resonance synchronization detecting circuit from the left end voltage of the resonance capacitor C5 in the resonance circuit is inputted to the in-phase input end of an internal comparator of the MCU, A voltage signal Vb which is divided by R7, R2, R6, R57 in the resonance synchronization detecting circuit from the right end voltage of the resonance capacitor C5 in the resonance circuit is inputted to the out-of-phase input end of the internal comparator of the MCU. At this time, the left end voltage of the resonance capacitor C5 is clamped at the mains supply voltage, the right end voltage thereof is directly pulled to the ground level by the IGBT (i.e. the left portion connected to the IGBT drive circuit in FIG. 4), at this time Va>Vb.

When the IGBT drive circuit shuts down the IGBT, due to the inductive effect for which the current cannot break, the coil disk LH in the resonance circuit keeps flowing from left to right, and charges the resonance capacitor C5 so that the right end voltage of the resonance capacitor C5 continues to increase until LH releases all current. The right end voltage of C5 reaches the maximum when the current of LH is 0, at this time Va<Vb.

When Va<Vb, it turns for the resonance capacitor C5 in the resonance circuit to discharge the coil disk LH in the resonance circuit. The current flows from the right end of the coil disk LH to the left end until C5 releases all electric energy, at this time the voltage on the left of C5 is equal to the voltage on the right. Since the coil disk LH still has a current flow from right to left, the current of the coil disk LH keeps flowing from right to left due to the inductive effect. At this time the left end voltage of the resonance capacitor C5 is clamped at the mains supply voltage, and the right end voltage thereof continues to be pulled down until Vb<Va when a pulse output of the rising edge is generated by the internal comparator in the MCU, and a counter starts to count to accumulate, meanwhile a timer is enabled to count the cycle. The pan-detecting module in the MCU comprises at least the internal comparator and the counter. Accordingly, the material-detecting module comprises at least the internal comparator and the timer.

The resonance circuit would repeat the process above since the energy thereof is not released. When Vb<Va happens again, the timer stops counting the cycle and the present cycle time value is read so as to determine the cooking appliance type. Certainly, for precisely reading the cycle time, the time of some of the following oscillating periods may be read and then to be averaged. The value of the counter is read after the resonance circuit continues to oscillate for a certain time (the resonance circuit oscillation caused by the pan-detecting pulse is over), such as 200 ms-500 ms.

The methods above which combine the electromagnetic drive circuit, the resonance circuit and the resonance synchronization detecting circuit are very effective on detecting the presence and the material of the ferromagnetic cooking appliance. Certainly, the detection of the presence and the material of the cooking appliance may also be performed in other ways. For example, an ultrasonic emission circuit and an ultrasonic detection circuit are provided in the electromagnetic heating unit, the pan-detecting module determines the presence of the cooking appliance based on whether the ultrasonic detection circuit detects an ultrasonic reflection signal, and the material-detecting module determines the material of the cooking appliance based on the frequency and amplitude range of the detected ultrasonic reflection signal.

Figure 3:
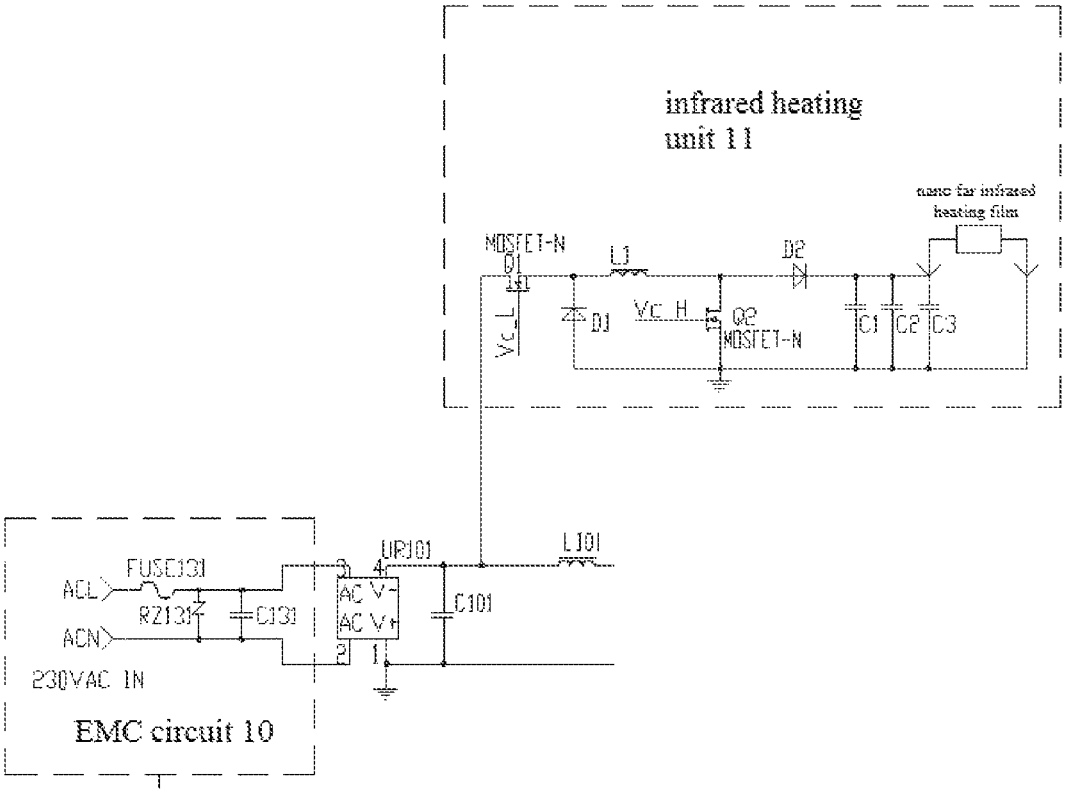
FIG. 3 is a structural diagram of the EMC circuit 10 and the infrared heating unit 11 of FIG. 1.

The composition of the circuit of the infrared heating unit is illustrated hereinafter in combination of FIG. 2 and FIG. 3. Generally, the infrared heating unit comprises an infrared heating circuit and an infrared heating drive circuit. The infrared heating circuit comprises an infrared heating film coupled between the null line and the live line of the mains supply, one end of the infrared drive circuit is coupled between the infrared heating film and the mains supply (i.e. one end of the infrared drive circuit may be coupled between the infrared heating film and the null line of the mains supply, but also may be coupled between the infrared heating film and live line of the mains supply), the other end of the infrared drive circuit is coupled with an infrared power adjusting module in the MCU, the infrared power adjusting module inputs a PWM signal of a second preset duty ratio to the infrared drive circuit based on the distributed heating power value.

Wherein the infrared heating film is preferably but not necessarily to be a nano far infrared heating film, as illustrated in FIG. 3.

Further, the infrared power adjusting module may also input the PWM signal of the second preset duty ratio to the infrared drive circuit at a preset time based on the zero-crossing signal detected by the zero-crossing detecting circuit in the electromagnetic heating unit.

Figure 2:
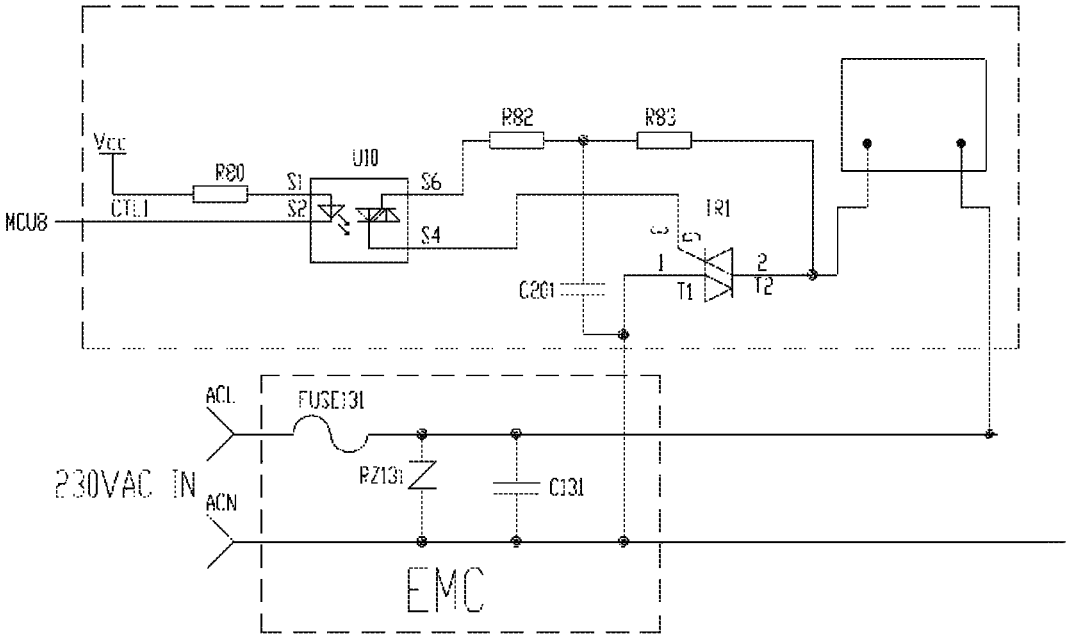
FIG. 2 is a structural diagram of the EMC circuit 10 and the infrared heating unit 11 of FIG. 1.

The present embodiment 1 provides two types of infrared drive circuit, as illustrated in FIG. 2. The first infrared drive circuit provided by the present embodiment 1 comprises an isolation subunit and a switch subunit, the switch subunit is coupled in series between the infrared heating film and the mains supply, the isolation subunit is coupled between the switch subunit and the infrared power adjusting module. That is, the isolation subunit is capable of receiving the PWM signal of the second preset duty ratio transmitted by the infrared power adjusting module to control the opening and closing of the switch subunit, so as to further control the conducting of the infrared heating circuit.

Specifically, the isolation subunit is an isolation optocoupler U10, the switch subunit is a TRIAC TR1, the isolation optocoupler U10 comprises a light emitting device and a photosensitive device. The positive pole S1 of the light emitting device is coupled with a DC power supply (supplying a voltage of 5V or 3.5V), the negative pole S2 is coupled with the infrared power adjusting module of the MCU, in this coupling way the photosensitive device conducts when the infrared power adjusting module has a low level. Of course, the positive pole S1 of the light emitting device may also be coupled with the infrared power adjusting module of the MCU, and the negative pole S2 of the light emitting device is grounded, in this coupling way the photosensitive device conducts when the infrared power adjusting module has a high level. The photosensitive device is a bidirectional thyristor, the first positive pole S6 is coupled with the second main electrode T2 of the TRIAC TR1, and the second positive pole S4 is coupled with the grid of the TRIAC TR1. The second main electrode T2 of the TRIAC TR1 is coupled with the infrared heating film, the first main electrode T1 of the TRIAC TR1 is coupled with the mains supply.

A first resistor R81 and a second resistor R82 are sequentially coupled in series between the first positive pole S6 of the photosensitive device and the second main electrode T2 of the TRIAC TR1. A first capacitor C201 is coupled in series between the common end of the first resistor R81 and the second resistor R82, and the first main electrode T1 of the TRIAC TR1, a third resistor R80 is coupled between the positive pole S1 of the light emitting device and the DC power supply. The first resistor R81, the second resistor R82, the third resistor R80 and the first capacitor C201 can function as to conduct the TRIAC TR1 with suitable current and voltage, and to filter and stabilize the control circuit of the TRIAC TR1.

This infrared drive circuit is a control circuit based on the adjustment of the TRIAC, the isolation subunit and the switch subunit may also be replaced with the corresponding components in a relay, that is, the infrared drive circuit is changed into a control circuit based on the adjustment of the relay. Certainly, the isolation subunit and the switch subunit may also be replaced with other electronic components.

Corresponding to the infrared drive circuit based on the TRIAC, two ways for adjusting the infrared heating power based on the zero-crossing detecting circuit and the infrared power adjusting module are provided. The first infrared heating power adjusting way is more stable, the second infrared heating power adjusting way has faster response speed.

Specifically, in the first infrared heating power adjusting way provided by the present embodiment 1: the current frequency is 50 HZ, the duration of a half-wave thereof is 10 ms, the duration of a square wave period in the PWM signal is set to be 100 ms, the infrared heating film heats when the PWM signal is in high level, and stops heating when the PWM signal is in low level.

Firstly, the infrared power adjusting module calculates the high level time t1 and the low level time t2 within a square wave period of the PWM signal based on the distributed heating power. Table 2 illustrates the relations of the distributed heating power with the high level time t1 and the low level time t2. In table 2, the maximum heating power that can be provided by the infrared heating film within a whole square wave period is 1000 W. When the heating power value distributed to the infrared power adjusting module is 800 W, the high level time t1 of the square wave period of the PWM signal is adjusted to 80 ms from 100 ms, the low level time t2 is adjusted to 20 ms from 0 ms correspondingly. That is, the infrared heating circuit conducts in 8 mains supply half-wave periods within a square wave period of the PWM signal. When the heating power value distributed to the infrared power adjusting module is 500 W, the high level time t1 of the square wave period of the PWM signal is adjusted again from 80 ms to 50 ms, the low level time t2 is adjusted from 20 ms to 50 ms correspondingly. In general, the higher the heating power value distributed to the infrared power adjusting module is, the longer the high level time t1 will be and the shorter the low level time t2 will be within a square wave period of the PWM signal.

In the heating process of the infrared heating film, if distributed with a new heating power, the infrared power adjusting module will recalculate the high level time and the low level time of the square wave period of the PWM signal based on the algorithm as illustrated in table 2, and then detect the zero-crossing signal through the zero-crossing detecting circuit. When the zero-crossing signal is detected, the infrared power adjusting module will send the recalculated PWM signal to the infrared drive circuit.

The second infrared heating power adjusting way provided by the present embodiment 1 differs from the first one in that: the duration of the square wave period in the PWM signal is set to be 10 ms which is the same as the mains supply half-wave period. Still take that the maximum heating power that can be provided by the infrared heating film within a whole square wave period is 1000 W as an example. When the heating power value distributed to the infrared power adjusting module is 800 W, the high level time t1 of a square wave period of the PWM signal is adjusted from 10 ms to 8 ms, the low level time t2 is adjusted from 0 ms to 2 ms correspondingly. When the heating power value distributed to the infrared power adjusting module is 500 W, the high level time t1 is again adjusted from 8 ms to 5 ms, the low level time t2 is adjusted from 2 ms to 5 ms correspondingly.

Similarly, in the heating process of the infrared heating film, if distributed with a new heating power, the infrared power adjusting module will also recalculate the high level time and the low level time of the square wave period of the PWM signal, and then detect the zero-crossing signal through the zero-crossing detecting circuit. When the zero-crossing signal is detected, the infrared power adjusting module will send the recalculated PWM signal to the infrared drive circuit.

TABLE 2

| Preset power (W) | Control period (ms) | Opening period (ms) | Closing period (ms) |
|---|---|---|---|
| 900 | 100 | 90 | 10 |
| 800 | 100 | 80 | 20 |
| 700 | 100 | 70 | 30 |
| 600 | 100 | 60 | 40 |
| 500 | 100 | 50 | 50 |
| 400 | 100 | 40 | 60 |
| 300 | 100 | 30 | 70 |
| 200 | 100 | 20 | 80 |
| 100 | 100 | 10 | 90 |

Illustrated above are only two ways for the TRIAC circuit adjusting the infrared heating power in combination with the infrared power adjusting module and the zero-crossing detecting circuit, wherein the power adjusting algorithm may also be used in other ways. The hardware of the adjusting circuit thereof may not in combination with the zero-crossing detecting circuit. The way the infrared power adjusting module adjusts the infrared heating power may not necessarily adopt the PWM signal.

Referring to FIG. 3, the second infrared drive circuit provided by the present embodiment 1 is a PFC circuit. The PFC circuit comprises energy-storage capacitors, a first switch, an inductor and a first diode, the energy-storage capacitor are coupled in series between the infrared heating film and the mains supply, the end coupled with the mains supply of the energy-storage capacitors is coupled with the source electrode of the first switch through the inductor, the end coupled with the infrared heating film of the energy-storage capacitors is coupled with the source electrode of the first switch through the first diode, the drain electrode of the first switch is coupled with the mains supply, the base electrode of the first switch is coupled with the infrared power adjusting module of the MCU.

In addition, the infrared drive circuit further comprises a second switch and a second diode, the common coupling end of the inductor and the energy-storage capacitors is coupled with the drain electrode of the second switch, the mains supply is coupled with the source electrode of the second switch, the second diode is coupled between the drain electrode of the second switch and the energy-storage capacitors, the base electrode of the second switch is coupled with the infrared power adjusting module of the MCU.

Wherein the first switch and the second switch correspond to Q1 and Q2 shown in FIG. 3, respectively, which are CMOS transistors with high power and high voltage resistance; the inductor corresponds to L1 in FIG. 3, the inductance value thereof is more than 400 uH; the first diode and the second diode correspond to D1 and D2 in FIG. 3, which are rectifier diodes with high-power and high reverse voltage resistance; the energy-storage capacitors correspond to C1, C2, C3 in FIG. 3, which are capacitors with large capacity and high voltage resistance. The base electrode of the first switch corresponds to Vc L in FIG. 3, and the base electrode of the second switch corresponds to Vc H in FIG. 3.

The way of the infrared power adjusting module in the MCU adjusting the infrared power in combination with PFC circuit is a voltage-type power adjusting way, the specific principle thereof is as follows:

When the infrared power adjusting module sends a PWM signal of full duty ratio to the base electrode Vc L of the first switch, and sends a PWM signal of zero duty ratio to the base electrode Vc H of the second switch, that is, the first switch Q1 is fully open and the second switch Q2 is fully closed, the half-wave rectified mains supply provides a stable DC voltage of about 310V to the infrared heating film after being rectified, filtered and voltage-stabilized by the inductor L1 and the energy-storage capacitors (C1, C2, C3).

When the output power is to be reduced, the infrared power adjusting module sends a PWM signal of a certain duty ratio to the base electrode Vc L of the first switch, and sends the PWM signal of zero duty ratio to the base electrode Vc H of the second switch, that is, the first switch Q1 is intermittently open and the second switch Q2 is fully closed. When the first switch Q1 is conducting, the rectified mains supply charges the energy-storage capacitors (C1, C2, C3) through the inductor L1 and the second diode D2 and meanwhile flows through the infrared heating film, so that the infrared heating film generates output power.

The larger the duty ratio of the PWM signal sent by the infrared power adjusting module to the base electrode Vc L of the first switch Q1 is, the greater the energy stored in the inductor L1 and the energy-storage capacitors (C1, C2, C3) is, and the higher the operating voltage of the infrared heating film is, and the greater the output power of the infrared heating film is correspondingly. The operating voltage of the infrared heating film may be adjusted within the range of 0 to 310 V by fully closing the second switch Q2 and adjusting the power of the infrared heating film with the first switch Q1.

When the power is required to be further increased, the infrared power adjusting module sends the PWM signal of the full duty ratio to the base electrode Vc L of the first switch, and sends a PWM signal of a certain duty ratio to the base electrode Vc H of the second switch, that is, the first switch Q1 is fully open and the second switch Q2 is intermittently open. When the second switch Q2 conducts, the rectified mains supply is shorted to ground by the second switch Q2, and high current flows through the inductor L1; due to the damping effect of the second diode D2, the current of the energy-storage capacitors (C1, C2, C3) cannot flow through the second switch Q2 to ground, and continue to discharge through the infrared heating film so that the infrared heating film continues to output the power. When the second switch Q2 is switched off, the inductor L1 keeps the present current flowing direction due to the inductance effect, and the current of the inductor L1 charges the energy-storage capacitors (C1, C2, C3) via the second diode D2 while flowing through the infrared heating film so that the infrared heating film continues to generate heat.

The larger the duty ratio of the PWM signal sent by the infrared power adjusting module to the base electrode VcH of the second switch is, the greater the energy stored in the inductor L1 and the energy-storage capacitors (C1, C2, C3) is, and the higher the operating voltage (the maximum operating voltage may reach to 550V) of the infrared heating film is, and the greater the output power of the infrared heating film is correspondingly. The operating voltage of the infrared heating film may be adjusted within the range of 310V to 550V by fully opening the first switch Q1 and adjusting the power of the infrared heating film with the second switch Q2.

Obviously, the specific forms of the infrared drive circuit and the infrared heating circuit are not limited by the descriptions above; any feasible form obtained by the existing technology is within the protection scope of the present embodiment 1.

Embodiment 2

Figure 6:
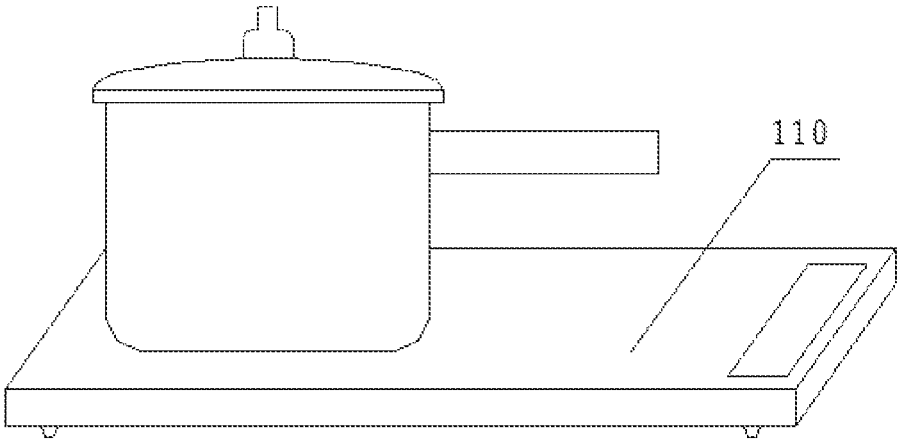
FIG. 6 is a structural diagram of a common electromagnetic heating device.

Referring to FIG. 6, the present embodiment 2 is mainly for illustrating a first implemented structure of the electromagnetic heating device. Specifically, the electromagnetic heating device comprises: a board 110 provided under the cooking appliance for supporting the cooking appliance; a coil disk 130 provided under the board 110 for electromagnetically heating the cooking appliance; an infrared heating assembly 120 mounted on the board 110 for infraredly heating the cooking appliance; an electric control panel 160 electrically connected with the coil disk 130 and the infrared heating assembly 120 for controlling the heating of the coil disk 130 and the infrared heating assembly 120.

Figure 7:
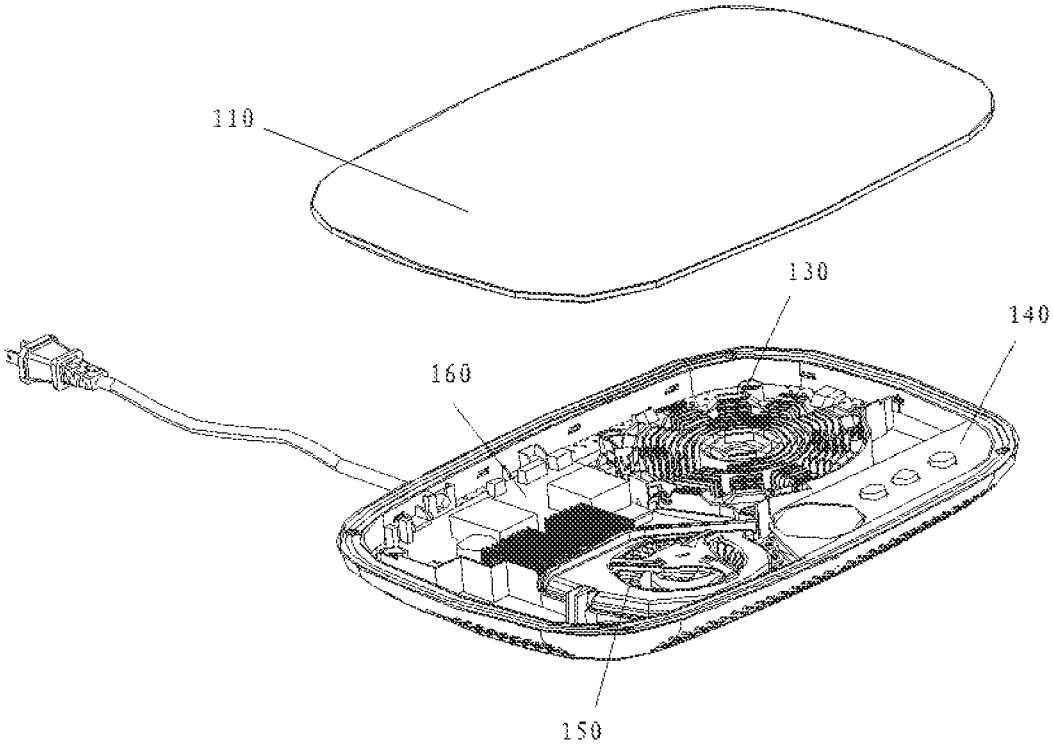
FIG. 7 is a structural diagram of the separated electromagnetic heating device of embodiment 2.

The electromagnetic heating device usually further comprises a bottom cover which is capped by the board 110. Referring to FIG. 7, both the coil disk 130 and the electric control panel 160 are housed within the bottom cover, in which a cooling fan 150 and a touch panel 140 are housed as well.

Figure 8:
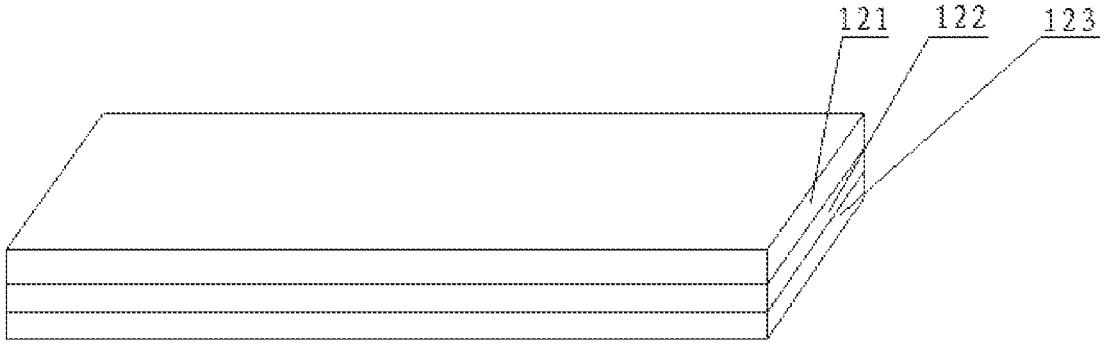
FIG. 8 is a structural diagram of the infrared heating assembly of embodiment 2.

The infrared heating assembly 120 may be mounted on the surface of the side near the cooking appliance of the board 110, or may be mounted on the surface of the side near the coil disk 130 of the board 110, or may be embedded inside the board 110. Take that the infrared heating assembly 120 is mounted on the surface of the side near the coil disk 130 of the board 110 as an example; the infrared heating assembly 120 comprises an infrared heating film 121, a heat reflecting film 122, and a heat insulating film 123. Referring to FIG. 8, it is obvious that FIG. 8 only shows a position relation between the board 110 and the infrared heating film 121, the heat reflecting film 122 and the heat insulating film 123, but does not constitute a size restriction to the infrared heating film 121, the heat reflecting film 122 and the heat insulating film 123. The infrared heating film 121 is attached to the board 110, the heat reflecting film 122 is attached to the infrared heating film 121, and the heat insulating film 123 is attached to the heat reflecting film 122.

Figure 9:
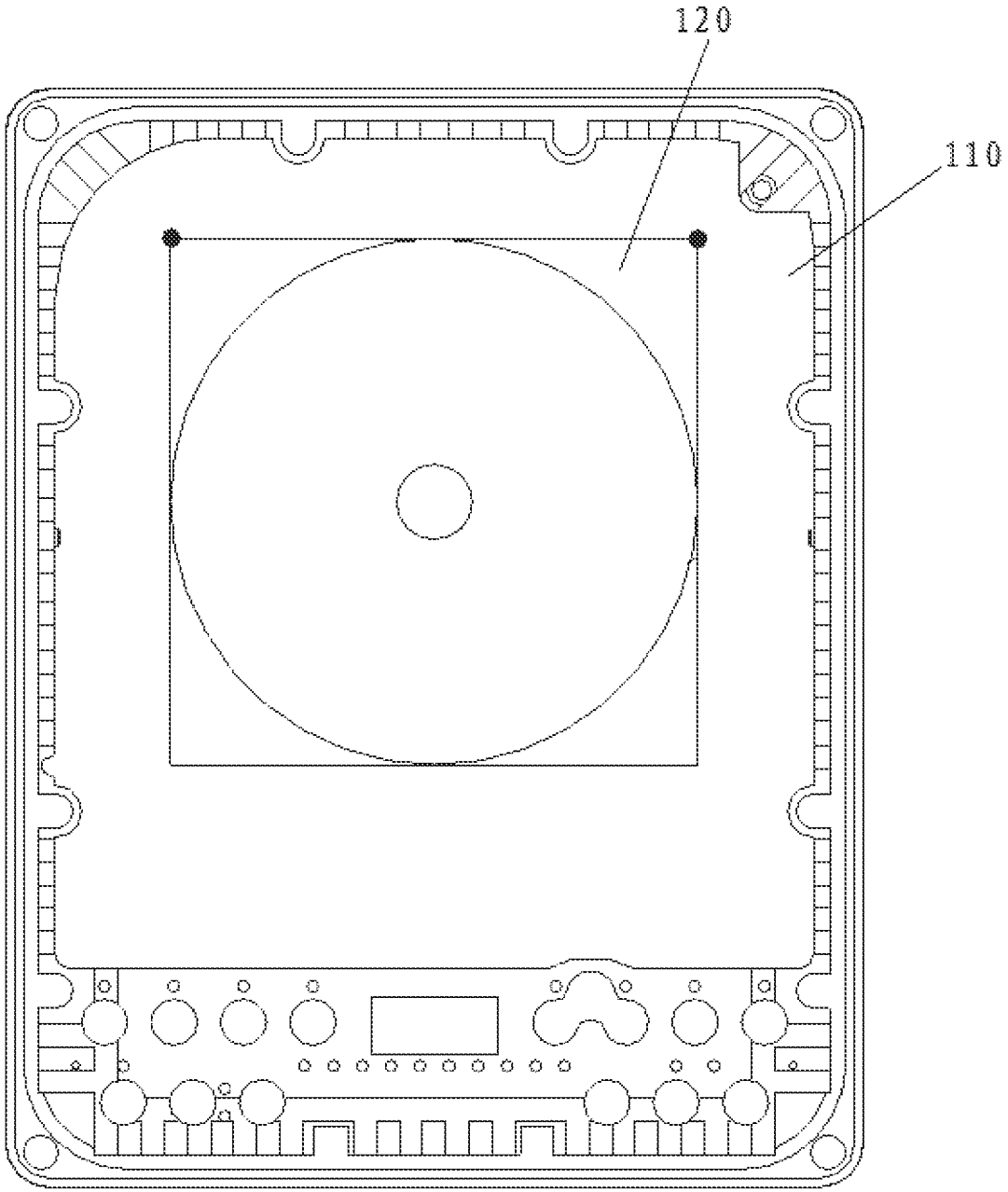
FIG. 9 is an upward view of the board of embodiment 2.

The shape of the infrared heating film 121 may be a rectangle, and the coil disk 130 may be internally tangent inside the infrared heating film 121, as shown in FIG. 9. Of course, the coil disk 130 may be externally tangent outside the infrared heating film 121, and sub-infrared heating films in a rectangle-shape may be provided around the four sides of the infrared heating film 121. In addition, the infrared heating film 121 may be in other shapes. Certainly, the infrared heating film 121 is preferably to be round so as to match the bottom shape of the cooking appliance, since the bottoms of most of the cooking appliances are round.

The infrared heating film 121 provided by the present embodiment 2 is an infrared heating film of a thin-film type, having a thickness of 5 um-20 um, a heating power of 0.1 W-15 W/cm2. The main components of a formula of the infrared heating film 121 of the thin-film type are tin dioxide, chrome trioxide, manganese dioxide, and nickel trioxide, the infrared heating film 121 of the formula is generally attached to the board 110 by spraying. The main components of another formula of the infrared heating film 121 in the thin-film type are tin tetrachloride, nickel tetrachloride, iron oxide, titanium tetrachloride, sodium chloride and tin dioxide, the infrared heating film 121 of these materials is attached to the board 110 by PVD deposition.

The infrared heating film 121 heats with double sides, the heat of one side is radiated directly to the cooking appliance, and the heat of the other side is re-transmitted to the cooking appliance by the reflection of the reflecting film. By providing the heat reflecting film 122, the heating of the side near the coil disk 130 of the infrared heating film 121 is prevented from being wasted, thereby the heating efficiency of the infrared heating film 121 is improved. In addition, the heat reflecting film 122 also prevents the infrared heating film 121 from radiating heat to the coil disk 130 so that the coil disk 130 is too high to affect the normal operation of the coil disk 130.

The heat insulating film 123 attached to the heat reflecting film 122 of the present embodiment 2 further reduces the radiation influence of the heating of the infrared heating film 121 on the coil disk 130. Of course, the heat insulating film 123 may not be provided when the heat insulating performance of the heat reflecting film 122 is relatively good. Further referring to FIG. 8, the infrared heating film 121, the heat reflecting film 122 and the heat insulating film 123 are sequentially provided on the board 110 along the axial direction of the coil disk 130.

In order to further reduce the influence of the heating of the infrared heating film 121 on the coil disk, the present embodiment 2 also controls the distance between the infrared heating assembly 120 and the coil disk 130. Specifically, the distance between the infrared heating assembly 120 and the coil disk 130 is in the range of 8 mm-11 mm. The heating efficiency of the coil disk 130 to the cooking appliance is affected if the distance between the infrared heating assembly 120 and the coil disk 130 is beyond the range. And the influence of the heating of the infrared heating film 121 on the coil disk 130 in terms of over high temperature cannot be effectively prevented if the distance between the infrared heating assembly 120 and the coil disk 130 is smaller than the range.

In general, a thermal temperature sensor is mounted on the coil disk 130, which indirectly detects the temperature of the cooking appliance bottom by detecting the temperature of the board 110 so as to perform the functions such as preventing the cooking appliance from being heated while it is empty.

In order to prevent the influence of the infrared heating film 121 on the temperature detecting of the thermal temperature sensor, a through-hole for the thermal temperature sensor to pass through is provided in the center of the infrared heating film 121, so that the thermal temperature sensor is able to directly contact the board 110. The diameter of the through-hole needs to ensure that the thermal temperature sensor is able to not only accurately detect the temperature of the cooking appliance but also keep electrically insulated from the infrared heating film 121, and the influence on the effective heating area of the infrared heating film is reduced to the most.

In addition, in the present embodiment 2, the heat reflecting film 122 may be obtained by sputtering a layer of metal or nanometer ceramic material on a transparent polyester film; the heat insulating film 123 may be obtained by laminating aluminum foil veneer, polyethylene thin film, fiber braid and metal coating with hot melt adhesive.

Embodiment 3

The present embodiment 3 provides an implementing method of a second structure of the electromagnetic heating device. Specifically, the electromagnetic heating device comprises: a cooking appliance 230; a board 210 provided under the cooking appliance 230 for supporting the cooking appliance 230; a coil disk 240 provided under the board 210 for electromagnetically heating the cooking appliance 230; an infrared heating assembly 220 mounted on the outer surface of the cooking appliance 230 for infraredly heating the cooking appliance 230; an electric control panel electrically connected with the infrared heating assembly 220 for controlling the heating of the coil disk 240 and the infrared heating assembly 220.

Figure 10:
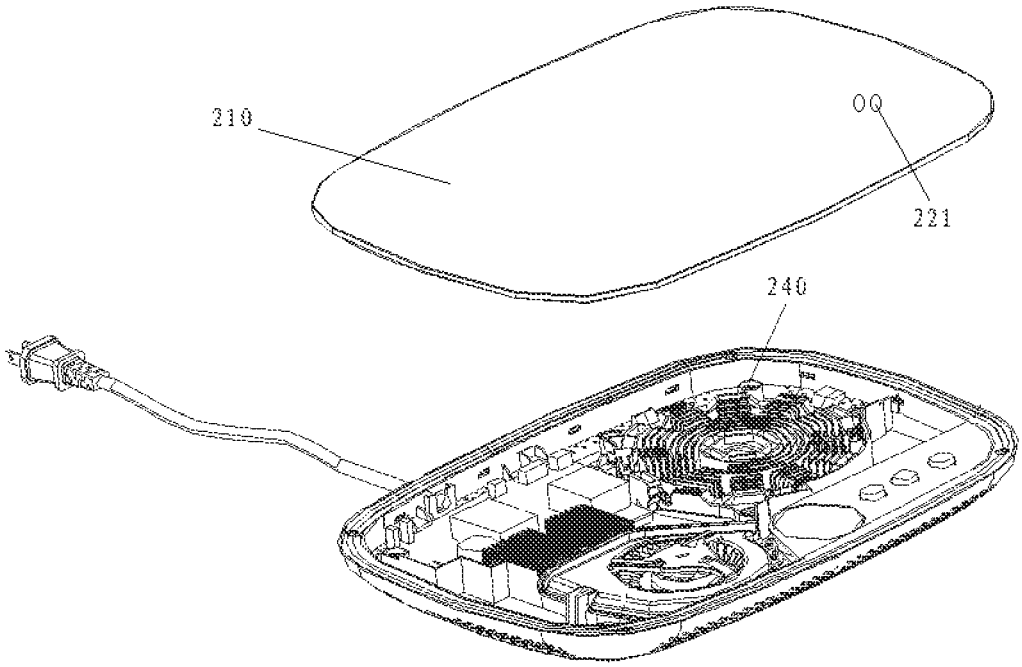
FIG. 10 is a structural diagram of the separated electromagnetic heating device of embodiment 3.

Referring to FIG. 10, the electromagnetic heating device of the present embodiment 3 also comprises a bottom cover, the internal structure of the bottom cover may adopt the same structure in embodiment 2, and the repetitive description is omitted here. In addition, the present embodiment 3 differs from the embodiment 2 in that the infrared heating assembly 220 is provided on the outer surface of the cooking appliance 230 rather than on the board 210.

Figure 11:
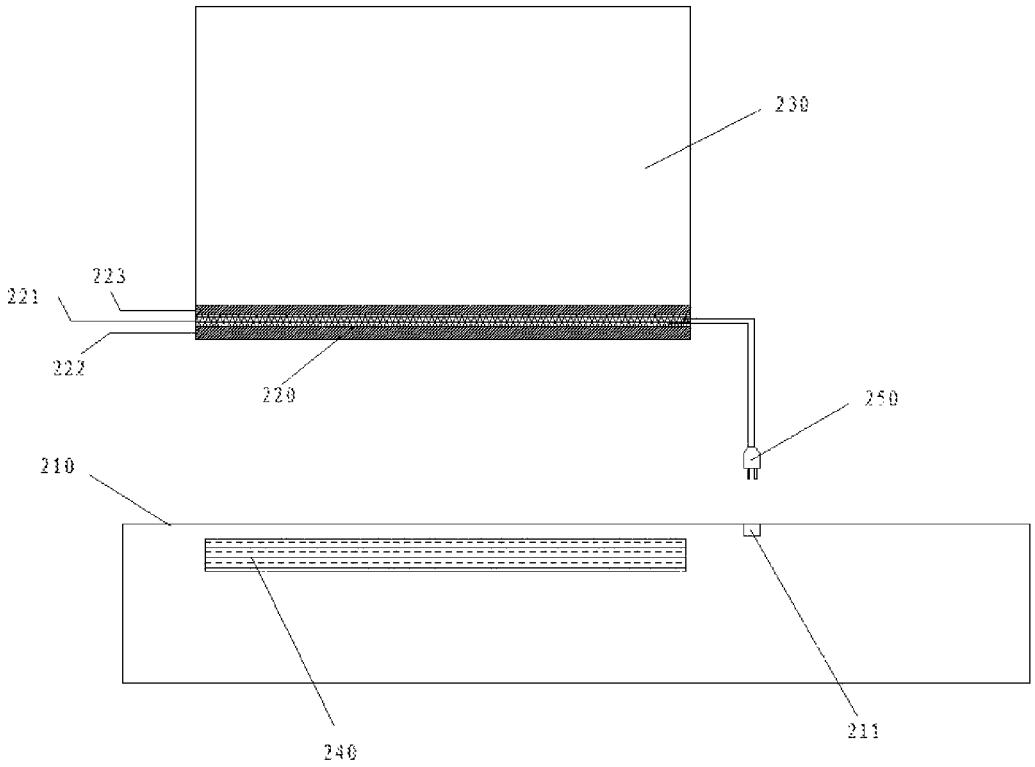
FIG. 11 is a structural diagram from a front view of the electromagnetic heating device of embodiment 3.

Referring to FIG. 11, The infrared heating assembly 220 comprises an infrared heating film 221 and a first electric insulating film 222, the infrared heating film 221 may be attached to the outer surface of the bottom wall of the cooking appliance 230 only, or may be attached to the outer surface of the side wall of the cooking appliance 230 only, or may be attached to the entire outer surface of the cooking appliance 230. Considering of reducing the thermal influence on the board 210 and preventing the infrared heating film 221 from being worn, the preferred solution of the present embodiment 3 is that the infrared heating film 221 is attached to the outer surface of the side wall of the cooking appliance 230. Considering of promoting the food in the cooking appliance to generate thermal convection during heating, the preferred solution of the present embodiment 3 is that the infrared heating film 221 is attached to the outer surface of the bottom wall of the cooking appliance 230. Since the infrared heating film 221 is energized, and in order to prevent the infrared heating film 221 from being shorted out by contacting with the external electric conductors, and to prevent the user from being shocked electrically by accidentally contacting the infrared heating film 221, the first electric insulating film 222 is attached to the infrared heating film 221.

The infrared heating film 221 provided by the present embodiment 3 is also an infrared heating film of a thin-film type, having a thickness of 5 um-20 um, a heating power of 0.1 W-15 W/cm2. The main components of a formula of the infrared heating film 221 of the thin-film type are tin dioxide, chrome trioxide, manganese dioxide, and nickel trioxide, the infrared heating film 221 of the formula is generally attached to the board 210 by spraying. The main components of another formula of the infrared heating film 221 of the thin-film type are tin tetrachloride, nickel tetrachloride, iron oxide, titanium tetrachloride, sodium chloride and tin dioxide, the infrared heating film 221 of these materials is attached to the cooking appliance 230 by PVD deposition.

When the base material of the cooking appliance 230 is electrically insulating material, such as the non-metallic material like ceramic, the infrared heating film 221 is not shorted out by contacting the cooking appliance 230. When the base material of the cooking appliance 230 is conductive material, such as metal like aluminum or stainless steel, a second electric insulating film 223 is further provided by the present embodiment 3 so as to prevent the infrared heating film 221 from being shorted out by contacting the cooking appliance 230. The second electric insulating film 223 is directly attached to the outer surface of the cooking appliance 230, the infrared heating film 221 is attached to the second electric insulating film 223, and the first electric insulating film 222 is attached to the infrared heating film 221.

Since the infrared heating assembly 220 is mounted on the outer surface of the cooking appliance 230, supplying power to the infrared heating assembly 220 becomes a problem. One solution is to provide a separate power supply to the infrared heating assembly 220, another solution provided by the present embodiment 3 is to provide a terminal 250 connecting the infrared heating film 221 on the infrared heating assembly 220, and provide a power port 211 into which the terminal 250 inserts on the board 250, that is, to supply power to the infrared heating assembly 220 with the power supply of the coil disk 240. In this way, providing another power supply assembly is avoided, and the heating of the infrared heating film 221 and the coil disk 240 may be controlled by the electric control panel that has already been within the electromagnetic oven.

In this case, the circuit and the mechanical structure of the electromagnetic heating device can be compatible with the existing heating circuit and heating system, and the electromagnetic and infrared heating can be realized without changing the existing circuits and the mechanical structure of the electromagnetic oven, thereby improving the performance of the electromagnetic heating device, and increasing the application scope and the user experience.

In addition, the first electric insulating film 222 and the second electric insulating film 223 may be the inorganic electric insulating film made from silicon oxide, silicon nitride, aluminum oxide or aluminum nitride etc., or may be the organic electric insulating film made from polyimide, polyethylene, PVDF or PTFE etc.

The electromagnetic heating devices of the above embodiments enable the electromagnetic heating device to be suitable for the cooking appliances other than the ferromagnetic cooking appliances by providing an infrared heating assembly, and controlling the heating of the coil disk and the infrared heating assembly with the electric control panel.

Further, when the coil disk continues to heat with a power lower than a certain power value, there will be a serious hard switching on the IGBT of the electromagnetic oven, which results in large loss, high temperature rise and shortened life of the IGBT. While the heating of the infrared heating unit is a resistive heating, which is different from the heating of the coil disk, therefore it is capable of heating continuously at a power lower than a certain power value.

Further, when the power entered by the user is higher than a certain value, not only the electromagnetic oven will generate a lot of noise, but also the electronic components of the electromagnetic oven such as the IGBT etc. will be more vulnerable to damages. Therefore, the electromagnetic heating devices of the above embodiments increase the lifetime of the electronic components of the electromagnetic oven, and reduce the vibration noise of the electromagnetic oven by means of the combined heating at a high power heating, that is, adopting the way of heating with the coil disk and the infrared heating assembly at the same time.

The above embodiments are merely illustrative of the present disclosure and are not intended to be limiting the present disclosure. Although the present disclosure has been described in detail with reference to the embodiments, it will be appreciated by those of ordinary skills in the art that the various combinations, modifications, or equivalents of the technical solutions of the present disclosure do not depart from the spirit and scope of the technical solutions of the present disclosure, and should be within the scope of the claims of the present disclosure.

Since the electromagnetic heating device of the embodiments of the present disclosure comprises an electro electromagnetic heating unit and an infrared heating unit, it can implement the heating of the heating appliances of different materials, the application thereof is wide and unrestricted; and since the infrared heating unit is comprised, the maximum heating power thereof is not limited by that of the coil disk.

The electromagnetic heating devices provided by the embodiments 2 and 3 of the present disclosure are suitable for the cooking appliances other than the ferromagnetic cooking appliances by providing an infrared heating assembly, and controlling the heating of the coil disk and the infrared heating assembly with the electric control panel; in addition, the electromagnetic heating devices of the present disclosure may reduce the vibration and noise and may implement a continuous heating with a low power when the heating power is high.

What is claimed is:

1. An electromagnetic heating device, comprising:

an electromagnetic heating unit, an infrared heating unit and a MCU, wherein:

the MCU is coupled with the electromagnetic heating unit and the infrared heating unit to control the electromagnetic heating unit and the infrared heating unit to heat individually or simultaneously, and the MCU comprises a power-detecting module and a power distribution module, wherein:

the power-detecting module detects a power value entered by a user and sends the power value to the power distribution module; and the power distribution module distributes power to the electromagnetic heating unit or the infrared heating unit based on the received power value entered by the user, including:

in accordance with a determination that the power value entered by the user is lower than a first preset power value, the power distribution module switches to enable the infrared heating unit to heat individually; and in accordance with a determination that the power value entered by the user is higher than the first preset power value, the power distribution module switches to enable the electromagnetic heating unit or the infrared heating unit to heat.

2. The electromagnetic heating device of claim 1, wherein the power distribution module switches to enable the electromagnetic heating unit to heat individually when the power-detecting module detects that the power entered by the user is higher than or equal to the first preset power value and lower than a second preset power value; and the power distribution module switches to enable the electromagnetic heating unit and the infrared heating unit to heat simultaneously when the power-detecting module detects that the power entered by the user is higher than or equal to the second preset power value, the second preset power value is higher than the first preset power value.

3. The electromagnetic heating device of claim 1, wherein the power distribution module switches to enable the electromagnetic heating unit and the infrared heating unit to heat simultaneously when the power-detecting module detects that the power entered by the user is higher than a second preset power value; and the power distribution module switches to enable the electromagnetic heating unit to heat when the power-detecting module detects that the power entered by the user is lower than the second preset power value.

4. The electromagnetic heating device of claim 3, wherein a heating power value distributed by the power distribution module to the electromagnetic heating unit is lower than or equal to the second preset power value and higher than the first preset power value when the power entered by the user is higher than the second preset power value; and a heating power value distributed by the power distribution module to the infrared heating unit is the difference value between the power value entered by the user and the power value distributed to the electromagnetic heating unit.

5. The electromagnetic heating device of claim 1, wherein the power distribution module switches to enable the electromagnetic heating unit and the infrared heating unit to heat simultaneously when the power-detecting module detects that the power entered by the user is higher than a third preset power value; the power distribution module switches to enable at least one of the electromagnetic heating unit and the infrared heating unit to heat when the power-detecting module detects that the power entered by the user is lower than the third preset power value; and wherein the third preset power value is 0.9-1 times of a rated heating power value of the electromagnetic heating unit.

6. The electromagnetic heating device of claim 1, wherein the MCU further comprises a material-detecting module, when the material-detecting module detects a ferromagnetic cooking appliance, the power distribution module switches to enable the electromagnetic heating unit and/or the infrared heating unit to heat the cooking appliance; and when the material-detecting module detects an un-ferromagnetic cooking appliance, the power distribution module switches to enable the infrared heating unit to heat the cooking appliance.

7. The electromagnetic heating device of claim 6, wherein the electromagnetic heating unit comprises:

a resonance circuit comprising a switch element, a resonance capacitor and a resonance inductor, the resonance capacitor is coupled with the resonance inductor in parallel, one of the common connecting ends of the resonance capacitor and the resonance inductor is coupled to the rectified mains supply, and the other common connecting end is coupled with a collector of the switch element;

an electromagnetic drive circuit, one end of the electromagnetic drive circuit is coupled with the MCU, the other end is coupled with a base electrode of the switch element;

a resonance synchronization detecting circuit, one end is coupled with the collector of the switch element so as to detect a voltage of the collector of the switch element, the other end is coupled with the MCU; and the material-detecting module determines the material of the cooking appliance by detecting a time interval of the adjacent reverse voltage outputted by the resonance synchronization detecting circuit after the MCU sending a pan-detecting pulse to the electromagnetic drive circuit.

8. The electromagnetic heating device of claim 1, wherein the MCU further comprises a pan-detecting module; when the pan-detecting module detects that the cooking appliance is not presented, the heating power distributed to the infrared heating unit and the electromagnetic heating unit by the power distribution module are zero; and when the pan-detecting module detects the presence of the cooking appliance, the power distribution module distributes the heating power to at least one of the infrared heating unit and the electromagnetic heating unit.

9. The electromagnetic heating device of claim 8, wherein the electromagnetic heating unit comprises:

a resonance circuit comprising a switch element, a resonance capacitor and a resonance inductor, the resonance capacitor is coupled with the resonance inductor in parallel, one of the common connecting ends of the resonance capacitor and the resonance inductor is connected to the rectified mains supply, the other common connecting end is coupled with a collector of the switch element;

an electromagnetic drive circuit, one end of the electromagnetic drive circuit is coupled with an electromagnetic power adjusting module in the MCU, the other end is coupled with the base electrode of the switch element;

a resonance synchronization detecting circuit, one end is coupled with the collector of the switch element so as to detect a voltage of the collector of the switch element, the other end is coupled with the MCU; and the pan-detecting module determines the presence of the cooking appliance by judging whether the times of the resonance synchronization detecting circuit outputting the voltage reverses is lower than a preset number after the MCU sending a pan-detecting pulse to the electromagnetic drive circuit.

10. The electromagnetic heating device of claim 1, wherein the electromagnetic heating unit comprises a resonance circuit and an electromagnetic drive circuit, one end of the electromagnetic drive circuit is coupled with the resonance circuit, the other end is coupled with the electromagnetic power adjusting module in the MCU, the electromagnetic power adjusting module inputs a PWM signal of a first preset duty ratio to the electromagnetic drive circuit based on the distributed heating power value.

11. The electromagnetic heating device of claim 1, wherein the infrared heating unit comprises an infrared heating circuit and an infrared drive circuit; the infrared heating circuit comprises an infrared heating film coupled between the null line and the live line of the mains supply, one end of the infrared drive circuit is coupled between the infrared heating film and the mains supply, the other end of the infrared drive circuit is coupled with an infrared power adjusting module in the MCU, the infrared power adjusting module inputs a PWM signal of a second preset duty ratio to the infrared drive circuit based on the distributed heating power value.

12. The electromagnetic heating device of claim 6, wherein the electromagnetic heating unit comprises a zero-crossing detecting circuit, one end of the zero-crossing detecting circuit is connected to the rectified mains supply so as to detect a zero-crossing signal of the mains supply, the other end is coupled with the MCU; and an infrared power adjusting module inputs a PWM signal of a second preset duty ratio to the infrared drive circuit at a preset time based on the zero-crossing signal detected by the zero-crossing detecting circuit.

* * * * *